US006203362B1

(12) United States Patent
Tsuji

(10) Patent No.: US 6,203,362 B1
(45) Date of Patent: Mar. 20, 2001

(54) CONNECTOR

(75) Inventor: Takeshi Tsuji, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 09/432,601

(22) Filed: Nov. 3, 1999

(30) Foreign Application Priority Data

Nov. 13, 1998 (JP) ..... 10-323972
Nov. 13, 1998 (JP) ..... 10-324039

(51) Int. Cl.[7] ..... H01R 13/62
(52) U.S. Cl. ..... 439/470; 439/596
(58) Field of Search ..... 439/206, 465, 439/466, 467, 596, 934.1

(56) References Cited

U.S. PATENT DOCUMENTS 3,854,787 * 12/1974 Snyder, Jr. ..... 439/465
4,900,277 * 2/1990 Inaba et al. ..... 439/465
5,315,062 * 5/1994 Hoshino ..... 439/466
5,498,177 3/1996 Tsuji ..... 439/596
5,769,648 * 6/1998 Hayashi ..... 439/206
6,030,252 * 2/2000 Oda et al. ..... 439/470

FOREIGN PATENT DOCUMENTS 4-351865 12/1992 (JP) .

* cited by examiner

*Primary Examiner*—Hien Vu
(74) *Attorney, Agent, or Firm*—Oliff & Berridge, PLC

(57) ABSTRACT

A cover is constructed of a pair of semi-cylindrical parts 36L, 36R combined with each other with a hinge (shielding means). A drainage port is formed on a lower surface of the cover. The hinge is so provided that an interior of the cover is prevented from being seen from outside through the drainage port. Even though water is linearly splashed at a high pressure on the drainage port 47 from the outside of the cover, the water collides with the hinge. Thus, the water does not reach the drainage port directly. Even though the water penetrates into the cover, it is reflected on the inner surface of the hinge and thus the force of the water is reduced. Accordingly, the water does not penetrate into the cover at a high pressure.

3 Claims, 12 Drawing Sheets

CONNECTOR

BACKGROUND OF THE INVENTION

1. Field of Invention

The present invention relates to a connector having a waterproof cover formed thereon.

2. Description of Related Art

FIGS. 11 and 12 show an example of the waterproof cover-provided connector disclosed in Patent Application Laid-Open No. 4-351865. The connector includes a connector housing (a) into which a terminal (not shown) is inserted from a rear end surface thereof and a two-part cylindrical cover (b) that is installed on a rear end portion of the connector housing (a). A terminal insertion opening (not shown) of the connector housing (a) is sealed with a rubber stopper (not shown) that is fitted on a rear end of the terminal to prevent water from penetrating into the connector housing (a). Further, the cylindrical cover (b) is so provided as to surround the terminal insertion opening to prevent it from being directly exposed to the outside. The cover (b) prevents the rubber stopper fitted on the terminal insertion opening from being exposed to water even though the water splashes on the connector, thus improving the waterproof function of the connector housing (a). An end of a corrugate tube (not shown) enclosing a bundle of electric wires is inwardly fitted into a rear portion of the cover (b) to prevent water from penetrating into the gap between the bundle of electric wires and the cover (b).

Even in the waterproof connector which prevents water from penetrating the connector housing (a) from the rear end thereof, the penetration of water from the gap between it and the cover (b), the gap between the covers (b), the gap between the cover (b) the corrugate tube, and the gap between the bundle of electric wires and the corrugate tube is unavoidable. Even though water penetrates into the connector housing (a) from the gaps, the rubber stopper prevents the water from entering into the connector housing (a). Thus, the connector housing (a) does not have a problem in its waterproof function.

However, once water penetrates into the cover (b) from the gaps, there is little possibility that the water is discharged to the outside through the gaps. It is not preferable that the penetrated water remain inside the cover (b). Thus, the cover (b) is provided with a drainage port (c) for discharging the penetrated water to the outside.

The waterproof connector of this kind is installed in a space such as an engine room of a vehicle whose lower surface is open to the outside and exposed to water. In the case where the connector is installed in the engine room, water splashed by a tire is applied to the waterproof connector when the tire contacts a puddle and some of the water may penetrate into the cover (b) through the drainage port (c). Since the force of the water is not great, the rubber stopper is sufficient enough to serve as a waterproof means.

In recent years, a cleaning gun that jets high-pressure cleaning water is used at many car-washing facilities. The cleaning gun is used to remove dirt such as dust or mud that has attached to the outer surface of a vehicle body. For a vehicle that has traveled on a seaside road or a road to which a snow-melting agent has been applied, the cleaning gun jets high-pressure cleaning water to the lower surface of the vehicle body to prevent it from being rusted due to salt. In this case, a part of the high-pressure cleaning water may be applied to the waterproof connector inside the engine room. The pressure of the high-pressure cleaning water is much greater than that of water splashed by the tire. Thus, the rubber stopper does not provide sufficient waterproofing means to stop water from entering into the cover (b) through the drainage port (c), when high-pressure water is applied.

SUMMARY OF THE INVENTION

The present invention has been made in view of the above-described problem. Therefore, it is an object of the present invention to prevent high-pressure water from penetrating into a cover from an open drainage port of the cover.

In order to solve the object, there is provided a connector comprising a connector housing into which a terminal connected with an electric wire is inserted from a terminal insertion opening formed at a rear end surface thereof; and a cylindrical cover installed on the rear end surface of the connector housing and having a drainage port such that the cover covers the terminal insertion opening and the electric wire. The connector further comprises shielding means for preventing an interior of the cover from being seen from outside through the drainage port.

The cover comprises a pair of semi-cylindrical parts which can be combined with each other. The semi-cylindrical parts are connected with each other with a plate-shaped hinge. The hinge is provided to cover the drainage port from the outside, with the semi-cylindrical parts combined with each other, thus constituting the shielding means.

When high-pressure water is applied to the drainage port from the outside of the cover, the water collides with the shielding means. Thus, the water does not reach the drainage port directly. Even though the water penetrates into the cover, the shielding means reduces the force of the high-pressure water. Thus, the shielding means does not penetrate into the cover.

When the semi-cylindrical parts are combined with each other and installed on the connector housing, the terminal insertion opening and an electric wire are covered with the semi-cylindrical parts, and the hinge located outside the drainage port constitutes the shielding means. Because the hinge serves as the shielding means, the cover has a simple configuration compared with the case where the shielding means is formed separately from the cover.

DETAILED DESCRIPTION OF PREFERRED EMBODIMENTS

A first embodiment of the present invention will be described below with reference to FIGS. 1 through 8.

Figure 1:
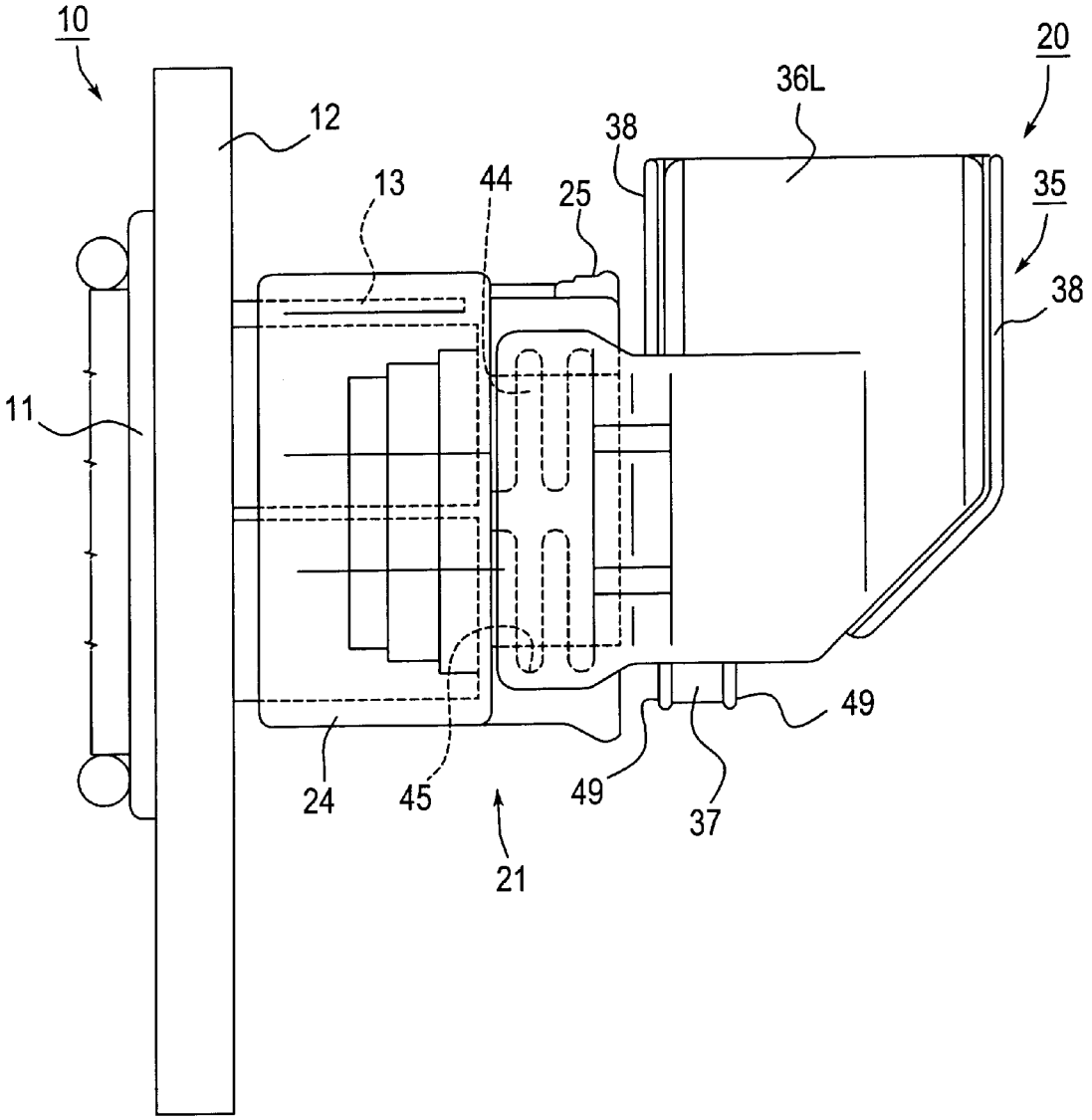
FIG. 1 is a side view showing a fit-in state of male and female connectors of a first embodiment of the present invention.
Figure 2:
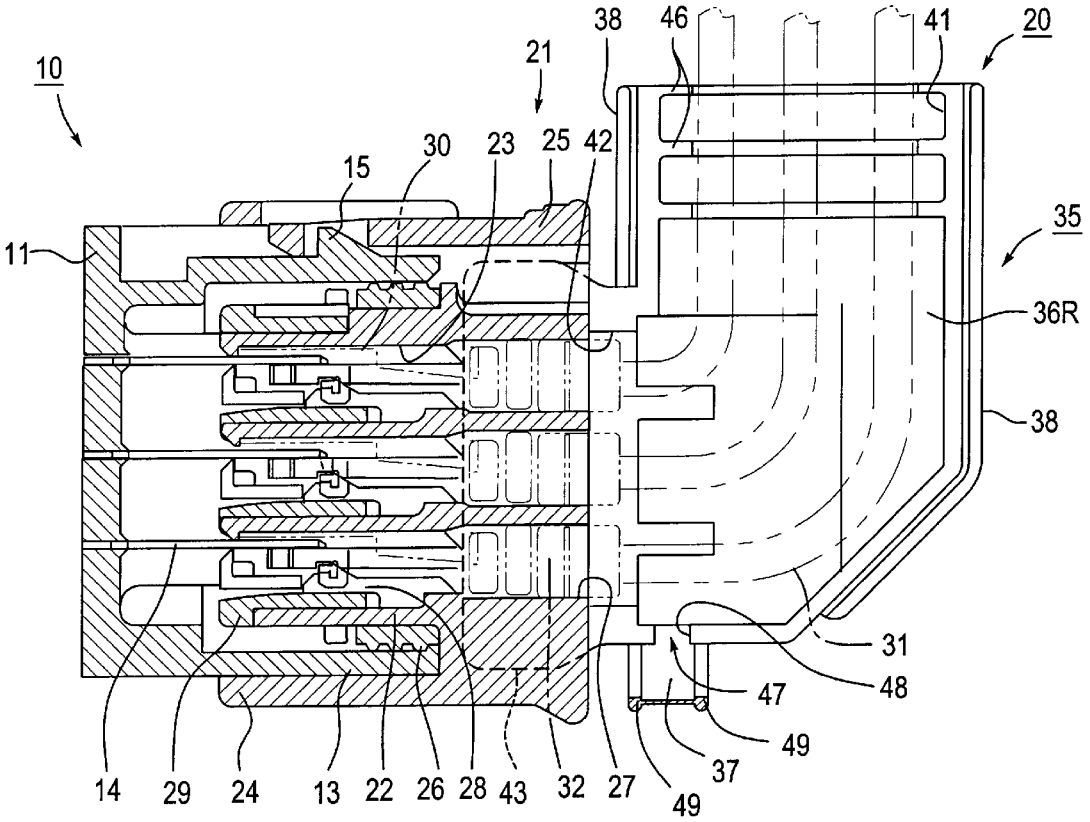
FIG. 2 is a sectional view showing the fit-in state of the male and female connectors shown in FIG. 1.
Figure 3:
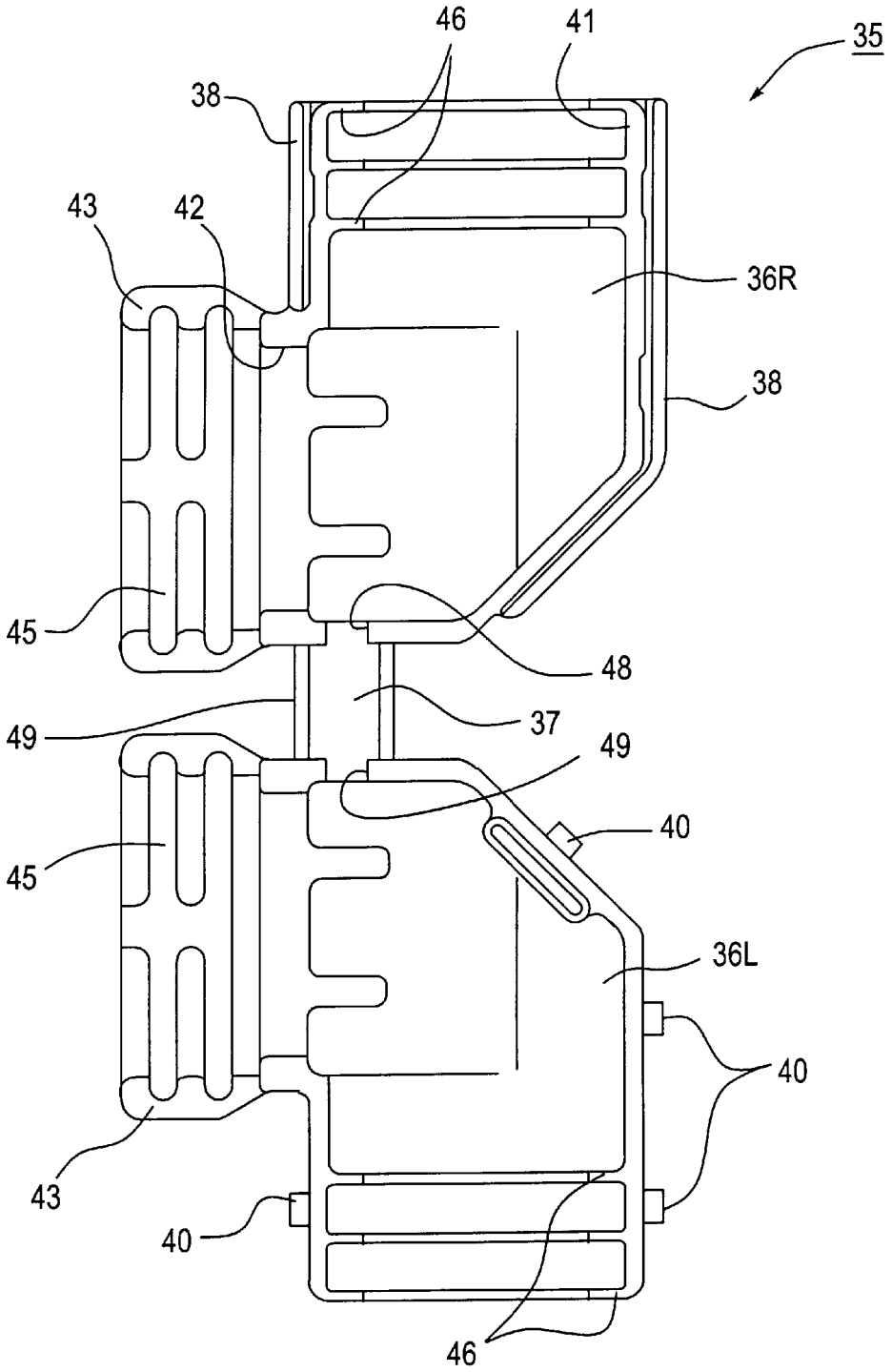
FIG. 3 is a side view showing a state in which parts of a cover are opened.
Figure 4:
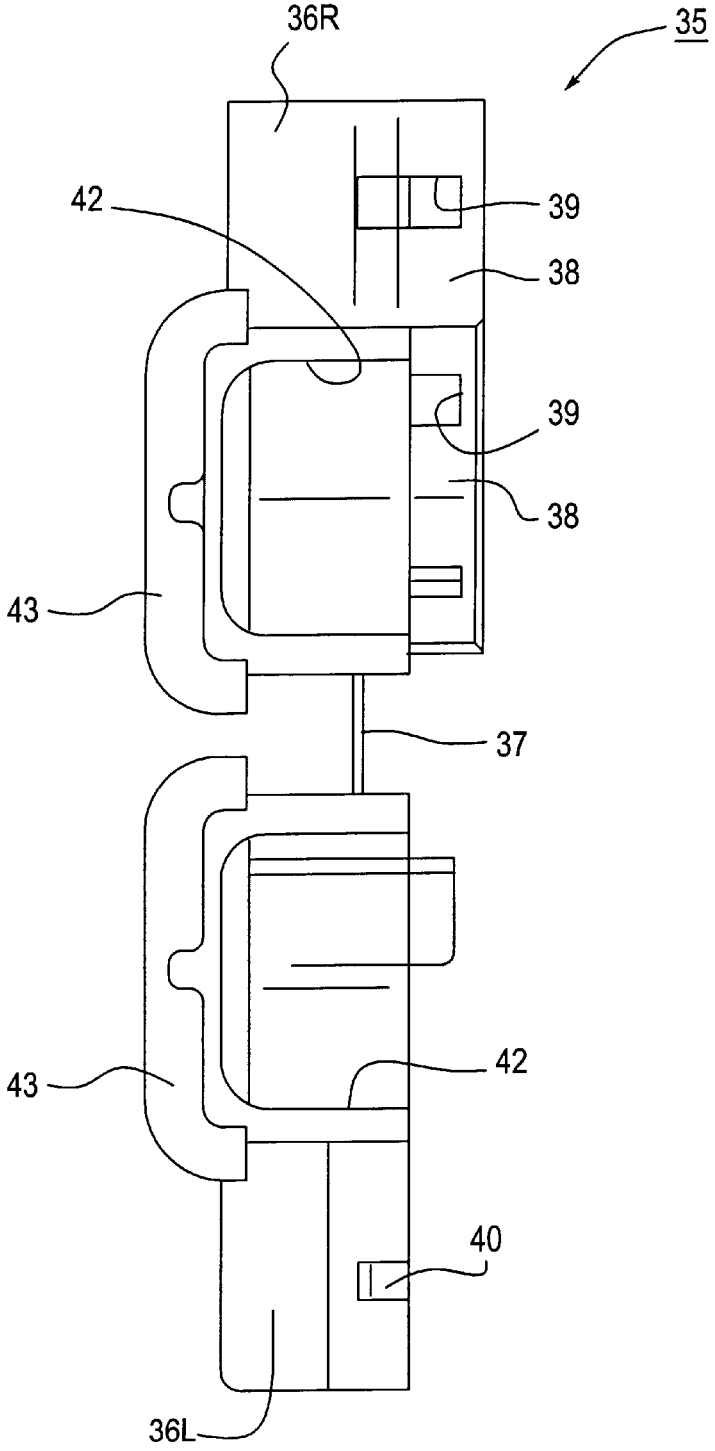
FIG. 4 is a front view showing a state of the parts of the cover are opened.
Figure 5:
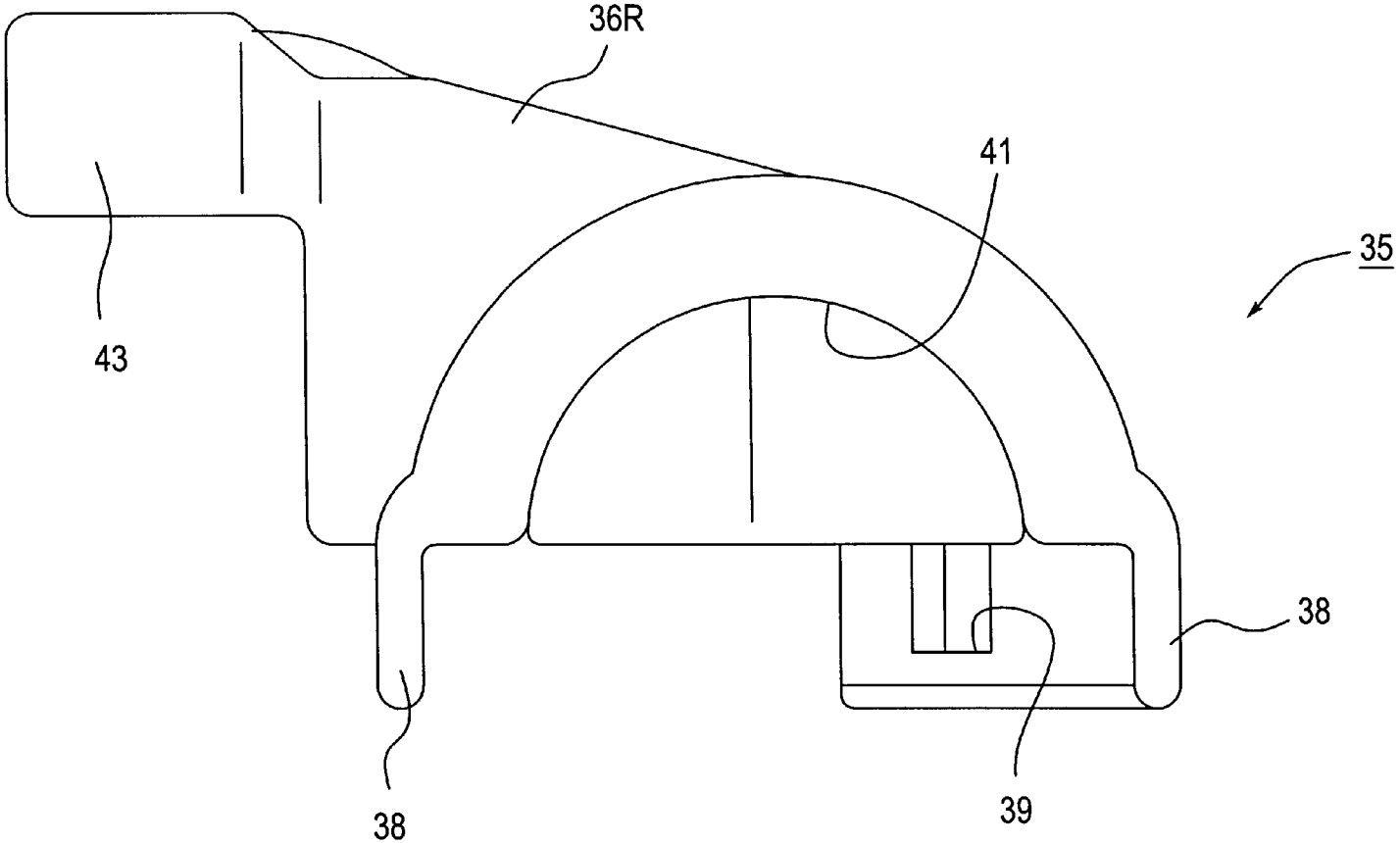
FIG. 5 is a plane view showing a state in which the parts of the cover are opened.
Figure 6:
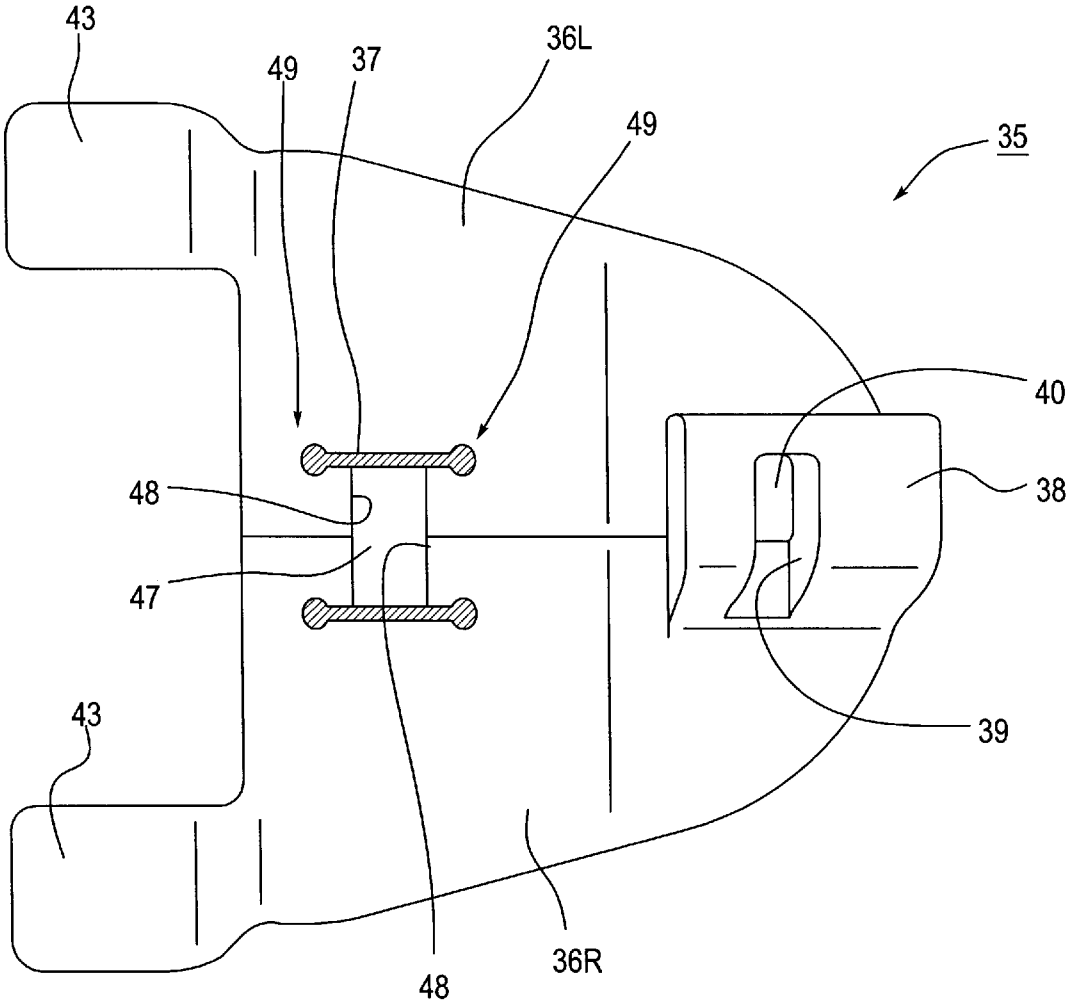
FIG. 6 is a partly cut-out bottom view showing a state in which the parts of the cover are combined with each other.
Figure 7:
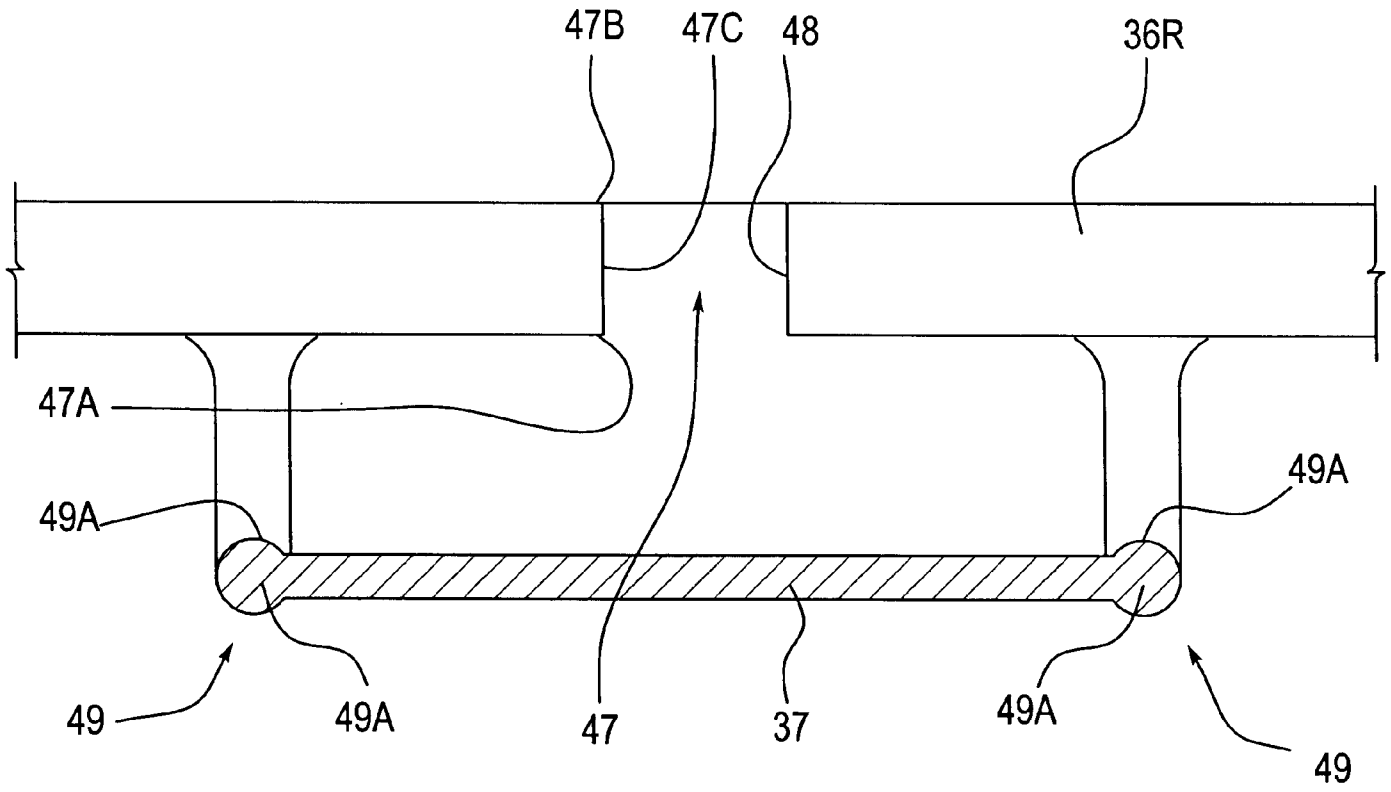
FIG. 7 is a partly enlarged sectional view showing a state in which the parts of the cover are combined with each other.
Figure 8:
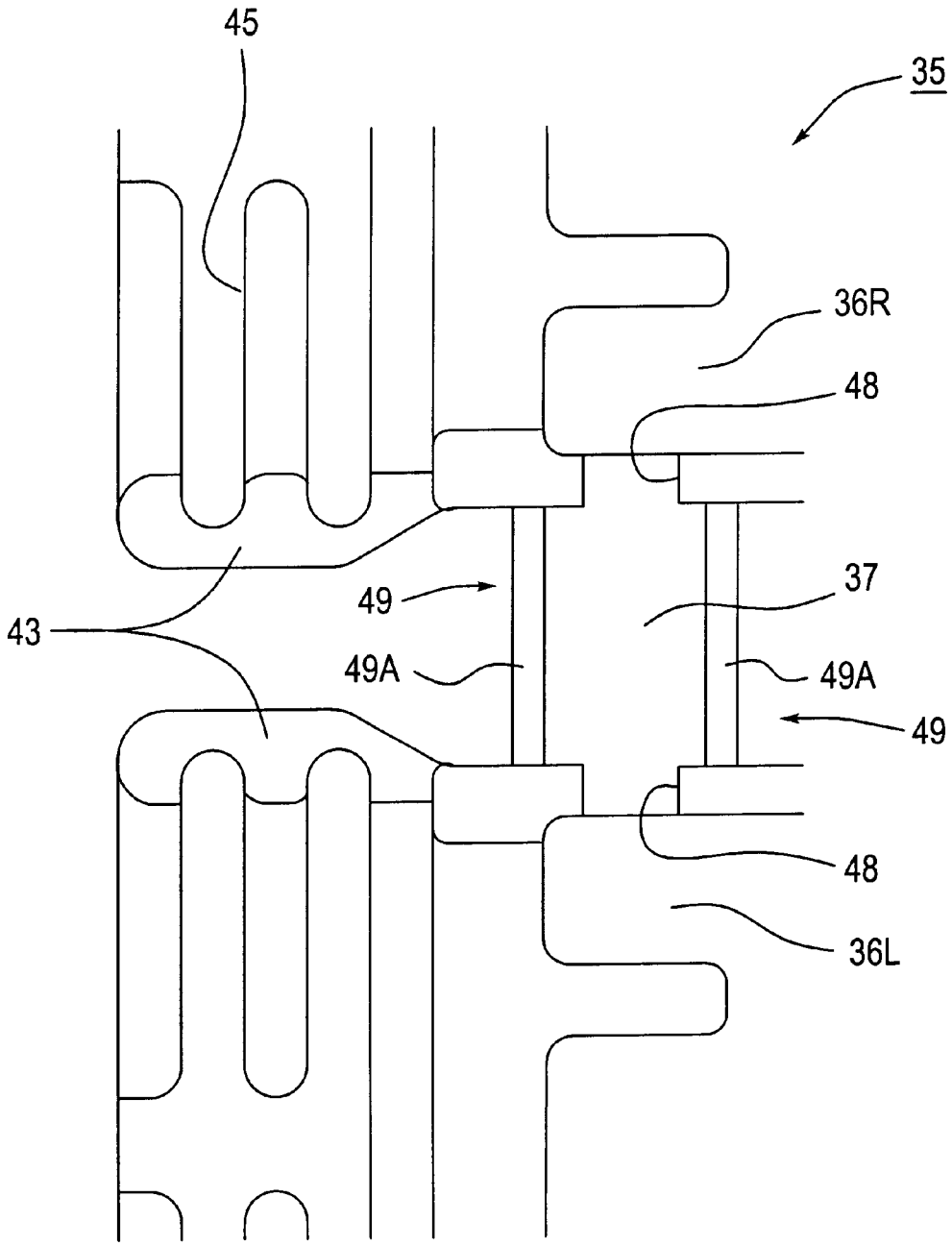
FIG. 8 is a partly enlarged side view showing a state in which the parts of the cover are opened.

FIG. 1 shows a state in which a male connector 10 fitted in a female connector (connector of the present invention) 20. The male connector 10 includes a connector housing 11 made of synthetic resin and having a flange portion 12 formed on the periphery thereof and a hood portion 13 projecting forward; and a plurality of male terminals 14 pressed into the connector housing 11 and projecting into the hood portion 13. The male connector 10 is installed on an unshown apparatus with means such as bolts. A locking projection 15 is formed on an upper surface of the hood portion 13.

The female connector 20 includes a connector housing 21, a cover 35, and a plurality of female terminals (constituent element of the present invention) 30 fixed to an electric wire 31. The connector housing 21 made of synthetic resin includes a housing body 22 in which a plurality of cavities 23 open on both front and rear surfaces thereof is formed; a cylindrical portion 24 open at its front portion and surrounding the font half of the housing body 22; and a seesaw-shaped locking arm 25 positioned at a cut-out space at the upper-surface side of the cylindrical portion 24. A seal ring 26 is installed on the periphery of the connector housing 21 such that the seal ring 26 is located at a rear end portion of the cylindrical portion 24. The connector housing 21 is fitted in the male connector 10 such that the cylindrical portion 24 is fitted on the hood portion 13 of the male connector 10. In the fit-in state, the inner periphery of the hood portion 13 is fitted on the seal ring 26 to seal the gap between the hood portion 13 and the housing body 22. Thus, water is prevented from penetrating into the housing body 22 from the gap between the hood portion 13 and the housing body 22. The locking arm 25 is locked to a locking projection 15 to unremovably lock the male connector 10 and the female connector 20 to each other.

A female terminal 30 is inserted into each cavity 23 from a terminal insertion opening 27 open on a rear end surface of the housing body 22. The female terminal 30 is unremovably held in the cavity 23, with the female terminal 30 locked doubly with a lance 28 formed inside the cavity 23 and a front retainer 29 installed on a front end of the housing body 22. A rubber stopper 32 is fitted on a portion of the female terminal 30 onto which the electric wire 31 is crimped. The rubber stopper 32 contacts the inner periphery of the terminal insertion opening 27 closely, thus preventing water from penetrating into the cavity 23 from the rear portion of the housing body 22. The front retainer 29 has a stopping function of preventing the seal ring 26 from being removed forward.

A cover 35 is installed on a rear end portion of the connector housing 21. The cover 35 is a one-piece molded product made of synthetic resin. The cover 35 includes a pair of left and right semi-cylindrical parts 36L, 36R connected with each other with a flat plate-shaped hinge (shielding means which is a constituent element of the present invention) 37. Before the left and right semi-cylindrical parts 36L, 36R are installed on the connector housing 21, they are open, with the inner peripheral surfaces thereof upward. The left and right semi-cylindrical parts 36L, 36R are combined with each other, with the inner peripheries thereof confronting each other to construct the cover 35. The left and right semi-cylindrical parts 36L, 36R are kept in a combined state by locking a locking projection 40 formed on an edge of an outer surface of the left semi-cylindrical part 36L to a locking hole 39 of an extended portion 38 formed at front and rear edges of the right semi-cylindrical part 36R (upper side in FIGS. 3 and 4).

The cover 35 has an upper opening 41 open upward and a front opening 42 open forward. A pair of left and right installing portions 43 which can be fitted on the rear end of the housing body 22 projects from the edge of the front opening 42. An installing groove 45 fittable on a vertically (circumferentially) extending rib 44 formed on an outer surface of the rear end portion of the housing body 22 is formed on the inner surface of the installing portion 43. By fitting the rib 44 in the installing groove 45, the cover 35 is connected to the connector housing 21, preventing the cover 35 from being moved in or removed from the connector housing 21. The cover 35 is installed on the connector housing 21 by combining the left and right semi-cylindrical parts 36L, 36R with each other, while the rib 44 is fitted in the installing groove 45. When the cover 35 is installed on the connector housing 21, a bundle of electric wires extending rearward from the terminal insertion opening 27 of the connector housing 21 is extended to an upward direction, with the bundle of electric wires covered with the cover 35, and is taken out to the outside of the cover 35 from the upper opening 41. A circumferential projection 46 is formed on the inner periphery of the upper opening 41. By fitting a corrugate tube on the projection 46, the corrugate tube is connected with the cover 35, with the bundle of electric wires inserted through the corrugate tube.

The cover 35 functions as a simple waterproof means for preventing water from penetrating into the connector housing 21 from the terminal insertion opening 27 open on the rear end surface of the housing body 22. Accordingly, when water splashed by a tire proceeds toward the female connector 20 provided in an engine room, the water splashes on the cover 35 but does not penetrate to the terminal insertion opening 27. The cover 35 serves as a simple waterproof means. Thus, if the water splashes on the female connector 20, it is unavoidable that a small amount of water penetrates into the cover 35 from the gap between the cover 35 and the connector housing 21 and the gap between the cover 35 and the corrugate tube.

Thus, the cover 35 has a drainage port 47 formed thereon to discharge water that has penetrated into the cover 35 to the outside of the cover 35. The drainage port 47 is disposed at the boundary between the left and right semi-cylindrical parts 36L, 36R. That is, a rectangular discharge cut-out portion 48 is formed on an edge (lower surface of cover 35 when left and right semi-cylindrical parts 36L, 36R are combined with each other) of each of the left and right semi-cylindrical parts 36L, 36R. The discharge cut-out portions 48 matches each other when the left and right semi-cylindrical parts 36L, 36R are combined with each other, thus constructing the drainage port 47. Water that has penetrated into the cover 35 drops from the drainage port 47 open on the lower surface of the cover 35.

The drainage port 47 is located immediately over the hinge 37. In other words, the hinge 37 is located outside the cover 35 and immediately below the drainage port 47. The relationship between the hinge 37 and the drainage port 47 will be described below. When the hinge 37 is viewed from a front side or a rear side thereof, it is curved in the shape of an approximately semi-circular arc. When the hinge 37 is viewed from a lower side thereof, it is rectangular. When the hinge 37 rectangular in a plan view is projected on the lower surface of the cover 35, the projected area of the hinge 37 is much larger than the area of the drainage port 47. That is, the projected area of the hinge 37 covers the drainage port 47 completely. The hinge 37 is connected with the left and right semi-cylindrical parts 36L, 36R at its left and right edges, respectively. Thus, when the drainage port 47 is viewed from a position lower left or right thereof, the hinge 37 also covers the drainage port 47 completely.

The space surrounded with the hinge 37 is open forward and rearward. The length and position of the hinge 37 in its longitudinal direction are so set that the interior of the cover 35 cannot be seen through the drainage port 47. That is, when the drainage port 47 is viewed from a position lower left or right thereof, an edge 47A of the drainage port 47 at the outer-surface side of the cover 35 is visible but an edge 47B of the drainage port 47 at the inner peripheral-surface side of the cover 35 is not visible, and only a part of the inner peripheral surface of the drainage port 47 is visible. That is, the hinge 37 is so provided that the interior of the cover 35 cannot be seen linearly through the drainage port 47.

The hinge 37 is curved semi-cylindrically when the left and right semi-cylindrical parts 36L, 36R are combined with each other. At this time, if the flexural rigidity of the hinge 37 is high, there is a possibility that workability deteriorates or the left and right semi-cylindrical parts 36L, 36R are combined with each other incorrectly. Therefore, the hinge 37 is thin plate-shaped as a whole to permit it to be deformed comparatively easily. But when the hinge 37 is thin, other component parts may catch and break it during movement. Thus, the hinge 37 of the first embodiment has a means for preventing its breakage and yet allowing the hinge 37 to be curved semi-cylindrically when the left and right semi-cylindrical parts 36L, 36R are combined with each other. That is, the hinge 37 has a pair of thick reinforcing portions 49 positioned at front and rear edges thereof and connected with the left and right semi-cylindrical parts 36L, 36R. The reinforcing portion 49 has a raised portion 49A raised sectionally like a circular arc at the inner and outer surface sides of the curved portion of the hinge 37. The thick portion is constructed of the raised portion 49A. A cross-section of the edge of the raised portion 49A is in the shape of an arc. The raised portion 49A does not have an angular portion (i.e., ridge line extending between both cylindrical portions 24).

For example, when the left and right semi-cylindrical parts 36L, 36R are caught by each other in transporting a large number of covers 35 packed in bags or boxes, with the left and right semi-cylindrical parts 36L, 36R open or when the covers 35 are taken out from the bags or boxes, there is a possibility that a drawing force, namely, a force of breaking the hinge 37 is applied to the front or rear ends of the hinge 37. But the thick reinforcing portion 49 formed at the front or rear ends of the hinge 37, thus allowing the hinge 37 to withstand the breaking force. That is, even though the breaking force is applied to the front or rear ends of the hinge 37, the hinge 37 will not be broken.

The outer edge of the reinforcing portion 49 is in the shape of an arc in section. That is, the outer surface of the reinforcing portion 49 does not have an angular portion. Let it be supposed that a ridge line portion is present on the outer surface of the reinforcing portion 49. In this case, when a drawing force is applied to the corner of the ridge line portions, it may be broken by a tensile stress applied thereto. Because the outer surface of the reinforcing portion 49 is in the shape of an arc, the degree of concentration of the tensile stress is low and is thus not broken.

Because the hinge 37 is thick in only the reinforcing portion 49, the flexural rigidity of the entire hinge 37 is comparatively low. Thus, when the left and right semi-cylindrical parts 36L, 36R are combined with each other, the hinge can be bent easily.

When water such as high-pressure cleaning water is sprayed on the male connector 10 and the female connector 20 fitted in each other, the seal ring 26 prevents the water from penetrating thereinto from the fit-in portion. Even though water may penetrate into the cover 35 from a slight gap of the portion where the connector housing 21 and the cover 35 are connected with each other or from a slight gap of the portion where the cover 35 and the corrugate tube (not shown) are connected with each other, the water penetrates thereinto through the slight gap little by little. Accordingly, even though the water which has penetrated into the cover 35 arrives at the terminal insertion opening 27 of the connector housing 21, owing to the waterproof function of the terminal insertion opening 27, a high pressure is not applied to the rubber stopper 32, but the surface of the rubber stopper 32 is wet. The water which has penetrated into the cover 35 is discharged to the outside of the cover 35 from the drainage port 47 open on the lower surface of the cover 35.

It is conceivable that water such as high-pressure cleaning water is sprayed at a high degree of force from below on the lower surface having the drainage port 47. The hinge 37 serving as the shielding means is provided in a wide range below the drainage port 47 such that the interior of the cover 35 cannot be seen linearly through the drainage port 47. Therefore, there is no possibility that the water penetrates into the cover 35 from the drainage port 47. That is, most of the water that has been splashed linearly upward toward the drainage port 47 collides with the peripheral surface of the hinge 37 and is reflected thereby. Even though a part of the water penetrates into the hinge 37 from an opening formed on the front surface of the hinge 37 or the rear surface thereof at a high pressure, the water does not reach the drainage port 47 and is reflected by the outer surfaces of the left and right semi-cylindrical parts 36L, 36R and the inner peripheral surface of the hinge 37. Thus, the water reaches the drainage port 47 at a reduced force. Even though the water arrives an opening of the drainage port 47 at its outer-surface side, it does not reach an opening of the drainage port 47 at its inner peripheral-surface side but collides with an inner peripheral surface 47C of the drainage port 47. As a result, the force of the water is reduced.

As described above, according to the first embodiment, even though water is splashed at a high pressure on the drainage port 47 open on the lower surface of the cover 35, the water does not penetrate into the cover 35 from the drainage port 47, at a high pressure. Accordingly, a high pressure is not applied to the rubber stopper 32 mounted on the terminal insertion opening 27 located on the rear end surface of the connector housing 21. That is, the rear end surface of the connector housing 21 has a reliable waterproof function.

The shielding means for preventing high-pressure water from penetrating into the cover 35 from the drainage port 47 is formed on the cover 35 as a specific member, but the hinge 37 for connecting the left and right semi-cylindrical parts 36L, 36R with each other serves as the shielding means. Thus, the shape of the cover 35 is simple.

Figure 9:
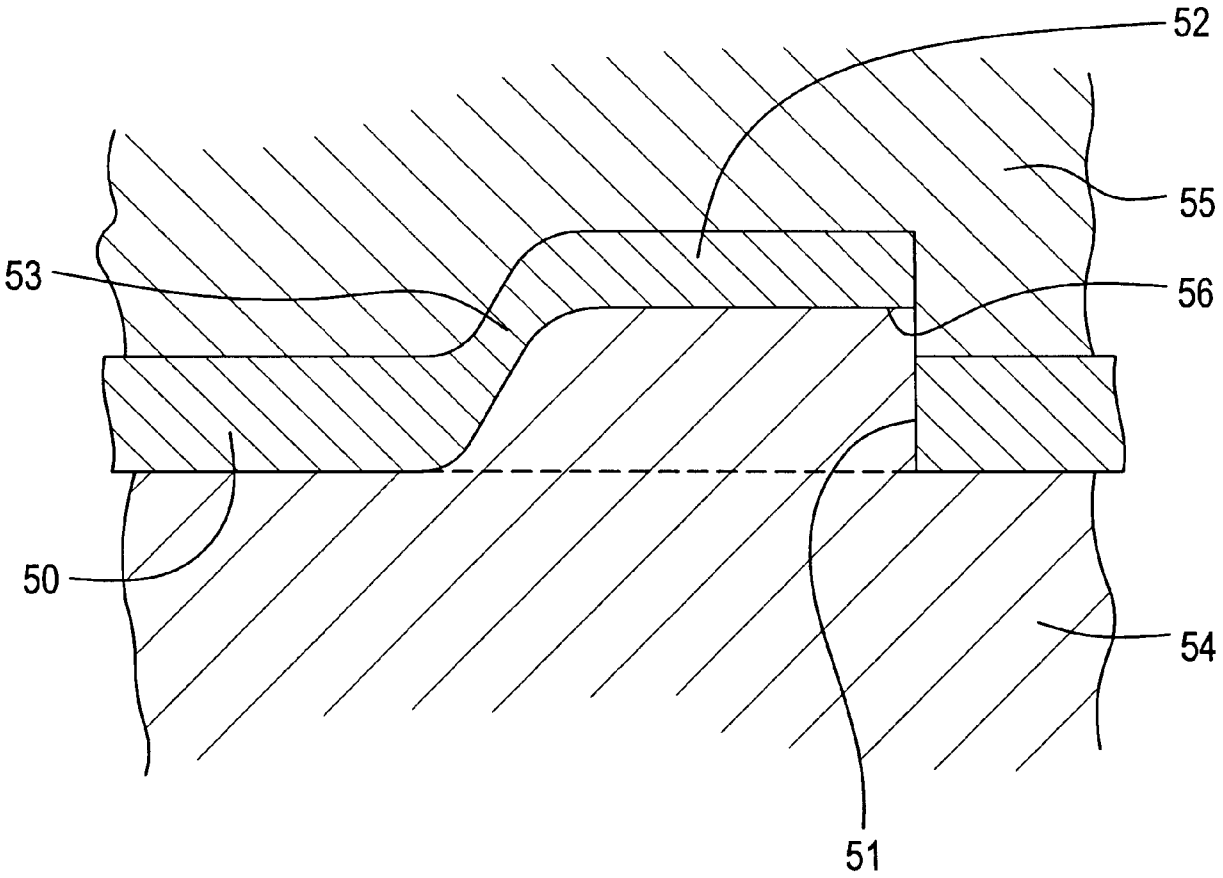
FIG. 9 is a partly enlarged sectional view showing a state in which a shielding means of a second embodiment and a drainage port thereof are formed by molding.

A second embodiment of the present invention will be described below with reference to FIGS. 9 and 10.

The construction of the drainage port and the shielding means of the second embodiment are different from those of the first embodiment. The other constructions of the second embodiment are the same as those of the first embodiment. Therefore, like parts are denoted by like reference numerals and description of the construction, operation, and effect thereof are omitted herein.

In the second embodiment, a rectangular shielding wall 52 (shielding means which is a constituent element of the present invention) is formed on the cover 50 on which a rectangular drainage port 51 is formed, such that the rectangular shielding wall 52 is integral with the rectangular drainage port 51. The shielding wall 52 is positioned a little outward (upper side in FIGS. 10 and 11) from the drainage port 51 such that the shielding wall 52 matches a region of an opening of the drainage port 51. Three sides of the shielding wall 52 and three sides of the edge of the opening of the drainage port 51 are connected with each other with a supporting portion 53. When the cover provided with the drainage port 51 and the shielding wall 52 is molded, as shown in FIG. 9, two dies 54 and 55 are provided at the inner and outer sides of the cover 50. Then, the dies 54 and 55 are closely contacted with each other at a gap 56 between the shielding wall 52 open along a side on which the supporting portion 53 is not formed and the drainage port 51. The dies 54 and 55 are opened in a direction (vertical direction in FIG. 9) perpendicular to the inner and outer surfaces of the cover 50.

Figure 10:
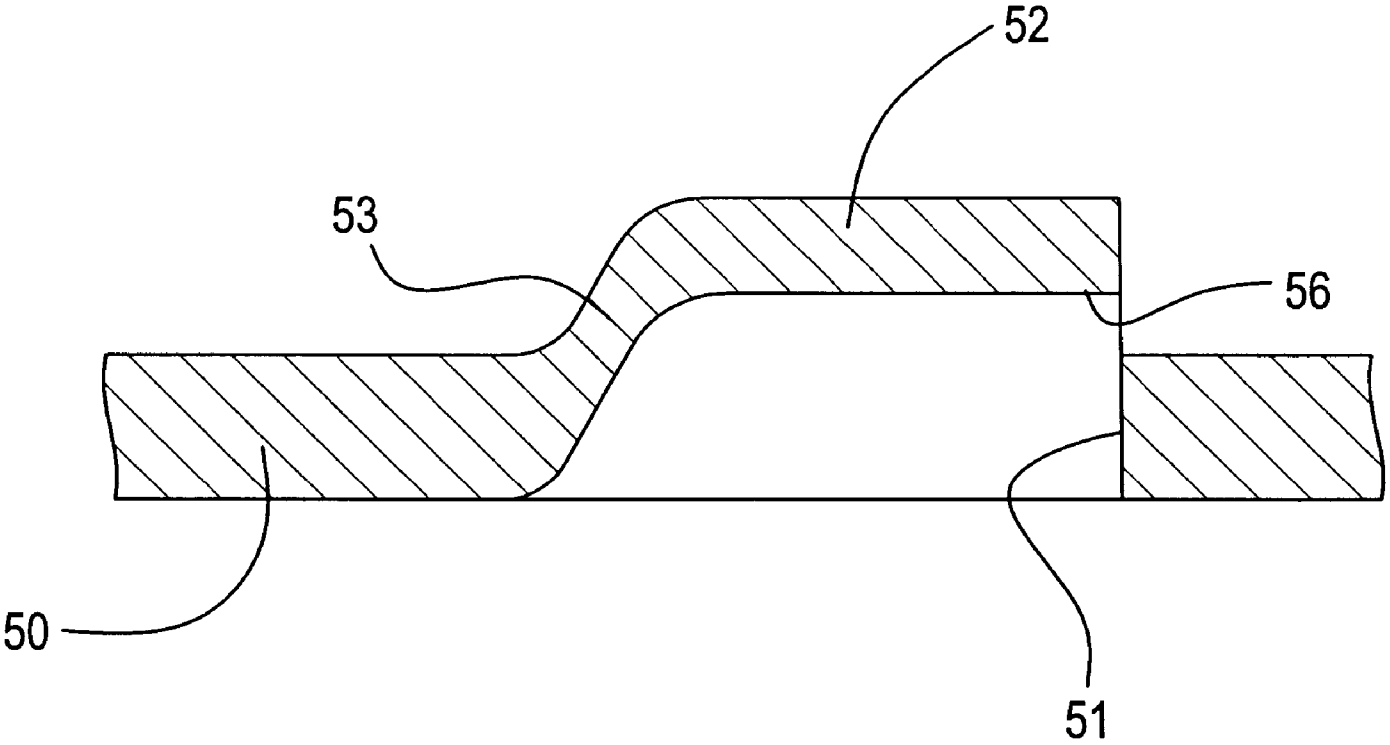
FIG. 10 is a partly enlarged sectional view showing the shielding means and the drainage port of the second embodiment.
Figure 11:
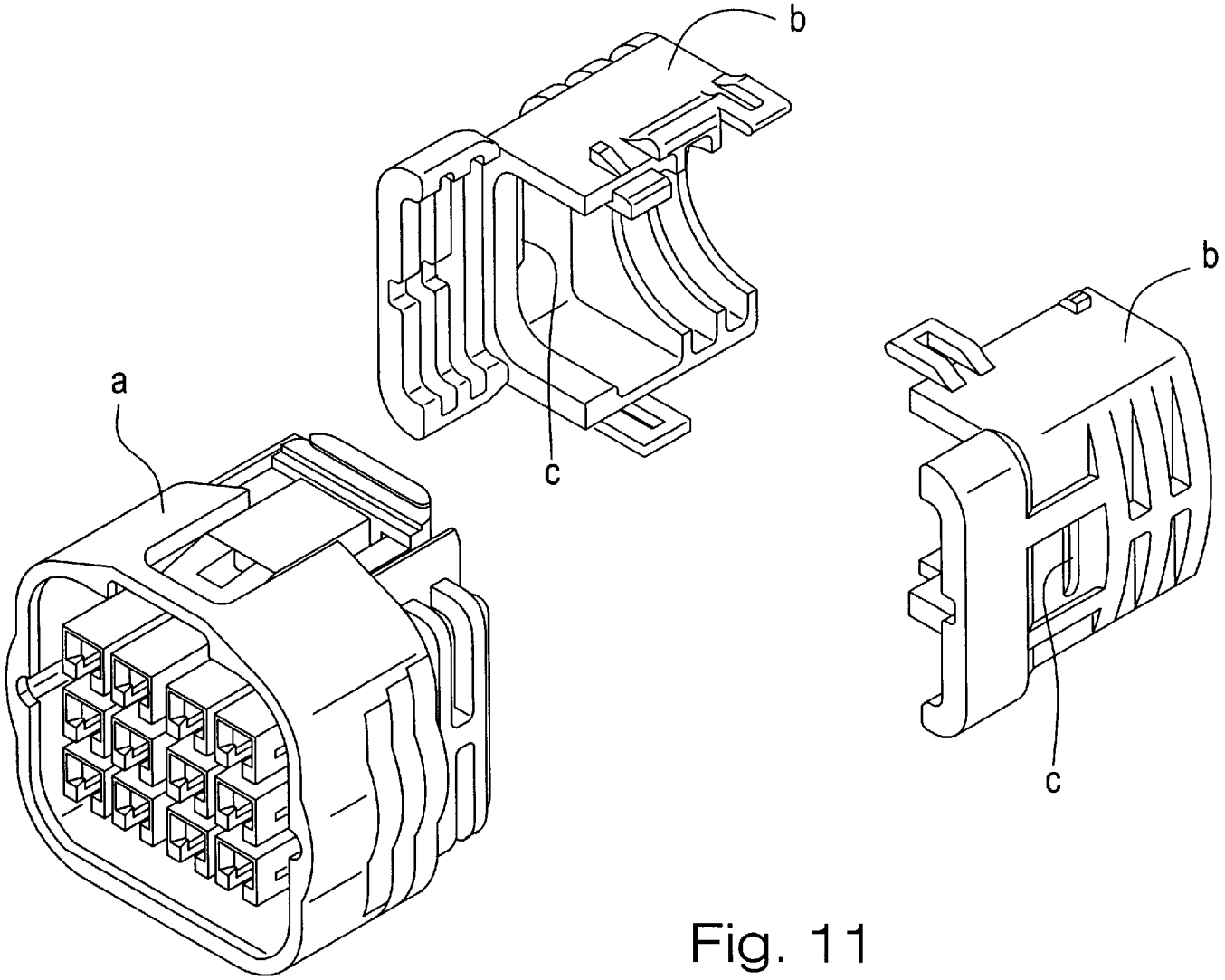
FIG. 11 is a perspective view showing a state before a cover is installed on a connector housing.
Figure 12:
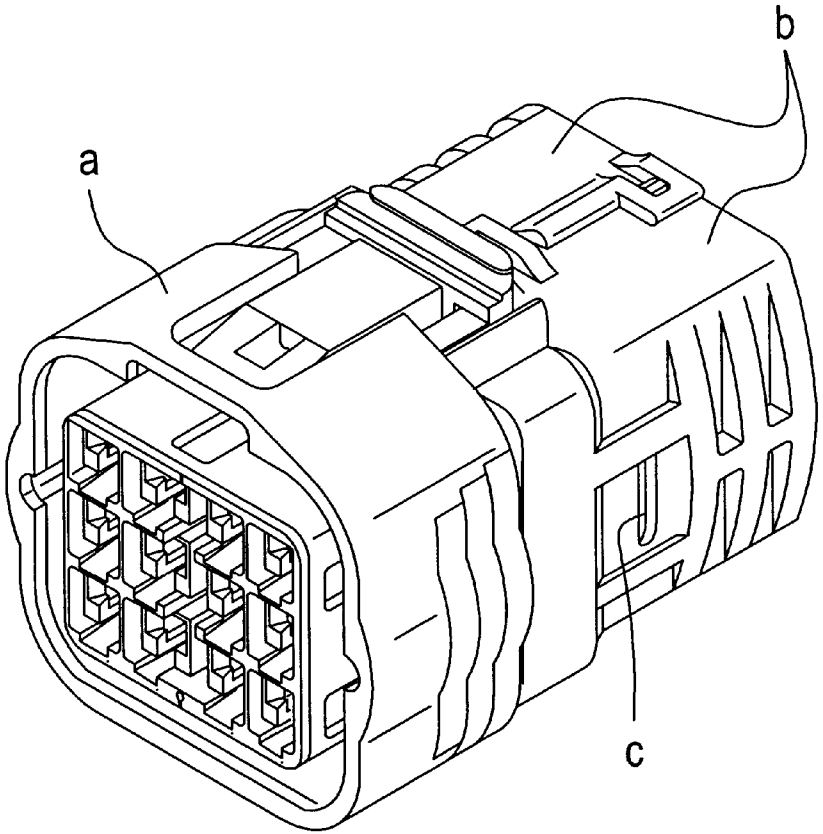
FIG. 12 is a perspective view showing a state in which the cover is installed on the connector housing.

According to the shielding wall 52 of the second embodiment, except the case where water splashes on the gap 56 in an upper right direction in FIG. 10, it is possible to prevent the high-pressure water from penetrating into the drainage port 51 directly. Water can be prevented from penetrating into the drainage port 51 from the upper right direction by forming a wall on the outer surface at a position right with respect to the drainage port 51.

The present invention is not limited to the first embodiment described with reference to the drawings. For example, embodiments described below are included in the technical scope of the present invention. Further, various changes and modifications can be made without departing from the scope of the present invention.

(1) In the above-described embodiment, the shielding means is provided outside the cover. But according to the present invention, the shielding means may be provided inside the cover or the length of the drainage port may be elongated to provide a plate-shaped shielding means on the inner periphery thereof.

(2) In the above-described embodiment, the shielding means is constructed of a one-piece plate. But according to the present invention, it is possible to arrange a plurality of plates by wrapping them partly and make the space to the drainage port maze-shaped.

(3) In the above-described embodiment, the shielding means is formed integrally with the cover. But according to the present invention, it is possible to form the shielding means integrally with the connector housing or form the shielding means as a single part and install it on the cover or the connector housing.

(4) In the above-described embodiment, one drainage port is constructed by combining two semi-cylindrical drainage cut-out portions with each other. But the connector of the present invention may apply to a single drainage port.

What is claimed is:

1. A connector for use with a terminal that is connected to an electric wire, the connector comprising:

a connector housing having a rear end surface, that defines a terminal insertion opening, the terminal being inserted into the terminal insertion opening;

a cover installed on the rear end surface of the connector housing, the cover having an interior and a drainage port such that said cover covers said terminal insertion opening and said electric wire, wherein said cover contains a pair of cover parts which can be combined with each other and said cover parts are connected with each other with a hinge, wherein said hinge is provided so as to cover said drainage port from an exterior of the connector so that when said cover parts are combined with each other the interior is protected.

2. The connector according to claim 1, wherein said cover parts are semi-cylindrically shaped.

3. The connector according to claim 1, wherein said hinge is plate-shaped.

* * * * *